US006659508B1

(12) United States Patent
Nemeth et al.

(10) Patent No.: US 6,659,508 B1
(45) Date of Patent: Dec. 9, 2003

(54) SECURITY DOCUMENTS

(75) Inventors: Joshua Robert Nemeth, Heathmont (AU); Wayne Kevin Jackson, Reservoir (AU)

(73) Assignee: Note Printing Australia Limited, Craigieburn (AU)

( * ) Notice: Subject to any disclaimer, the term of this patent is extended or adjusted under 35 U.S.C. 154(b) by 102 days.

(21) Appl. No.: 09/889,906

(22) PCT Filed: Jun. 22, 2000

(86) PCT No.: PCT/AU00/00703

§ 371 (c)(1),
(2), (4) Date: Jul. 24, 2001

(87) PCT Pub. No.: WO01/00426

PCT Pub. Date: Jan. 4, 2001

(30) Foreign Application Priority Data

Jun. 25, 1999 (AU) ..... PQ1199

(51) Int. Cl.[7] ..... B42D 15/00; B42D 15/10

(52) U.S. Cl. ..... 283/93; 283/72; 283/86; 283/91; 283/109; 428/195; 428/199; 428/913.3; 428/915; 428/916; 281/2; 281/5; 402/79

(58) Field of Search ..... 283/72, 91, 86, 283/93, 109; 428/195, 199, 913.3, 915, 916; 281/2, 5; 402/79

(56) References Cited

U.S. PATENT DOCUMENTS 4,033,059 A * 7/1977 Hutton et al. ..... 283/91
4,163,570 A * 8/1979 Greenaway ..... 283/67
4,405,676 A * 9/1983 Pohl ..... 428/913
4,417,784 A * 11/1983 Knop et al. ..... 283/91
4,588,212 A * 5/1986 Castagnoli ..... 283/91
4,715,623 A * 12/1987 Roule et al. ..... 283/91
4,869,532 A * 9/1989 Abe et al. ..... 283/88
4,988,126 A * 1/1991 Heckenkamp et al. ..... 283/92
5,122,813 A * 6/1992 Lass et al. ..... 283/67
5,138,604 A * 8/1992 Umeda et al. ..... 283/91
5,199,744 A * 4/1993 Shenton ..... 283/91
5,503,902 A * 4/1996 Steenblik et al. ..... 428/172
5,582,103 A * 12/1996 Tanaka et al. ..... 101/32
5,714,213 A * 2/1998 Antes et al. ..... 428/913
5,762,378 A * 6/1998 Phillips ..... 283/72

(List continued on next page.)

FOREIGN PATENT DOCUMENTS

| | | | |
|---|---|---|---|
| CA | 2224758 | | 12/1998 |
| EP | 0 194 042 | A2 | 9/1986 |
| GB | 1510964 | * | 5/1978 |
| WO | WO 90/02658 | | 3/1990 |
| WO | WO 94/29119 | | 12/1994 |

*Primary Examiner*—Monica Carter
*Assistant Examiner*—Mark Henderson
(74) *Attorney, Agent, or Firm*—Schnader Harrison Segal & Lewis LLP

(57) ABSTRACT

A security document, banknote, bond, travellers check, passport or token, including a substrate (1), said substrate having a device including a first macro-embossing (2, 3) of the substrate having a predetermined feature, and a second micro-embossing of smaller dimensions formed in or on said predetermined feature of said embossing. The first embossing being formed to hide and reveal said second embossing at predetermined viewing angles α, β. The macro-embossing may comprise lines having a height of about 20 microns and a spacing of 80 microns, and the micro-embossing in the form of lines or dots (4) to a height of about 2 to 5 microns. The lines have a predetermined height (H) and a predetermined spacing (S) such that the ratio S:H is typically from about 6:1 to 2:1. A transparent portion or clear window (W) of a polymer substrate (1) can be provided with embossing such that the first embossing is able to hide and reveal the finer second embossing at various viewing angles by using the gloss and transmission properties of the transparent substrate rather than the traditional reflection and absorption properties of the printed media.

5 Claims, 5 Drawing Sheets

U.S. PATENT DOCUMENTS 5,772,248 A * 6/1998 Phillips ..... 283/91
5,915,731 A * 6/1999 Jackson ..... 283/91
5,958,528 A * 9/1999 Bernecker ..... 428/195
6,015,604 A * 1/2000 Stahl ..... 428/195
6,036,233 A * 3/2000 Braun et al. ..... 283/91
6,060,143 A * 5/2000 Tompkin et al. ..... 428/195
6,273,473 B1 * 8/2001 Taylor et al. ..... 283/72
6,369,919 B1 * 4/2002 Drinkwater et al. ..... 283/86

* cited by examiner

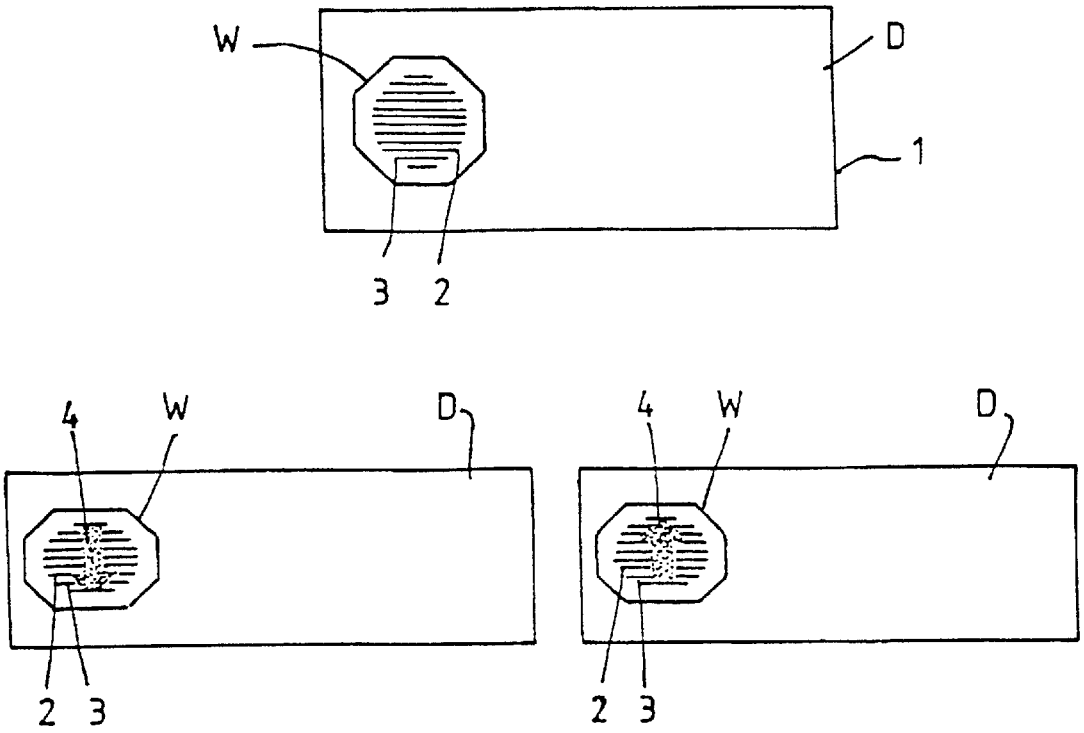
FIG. 5.
FIG. 8.
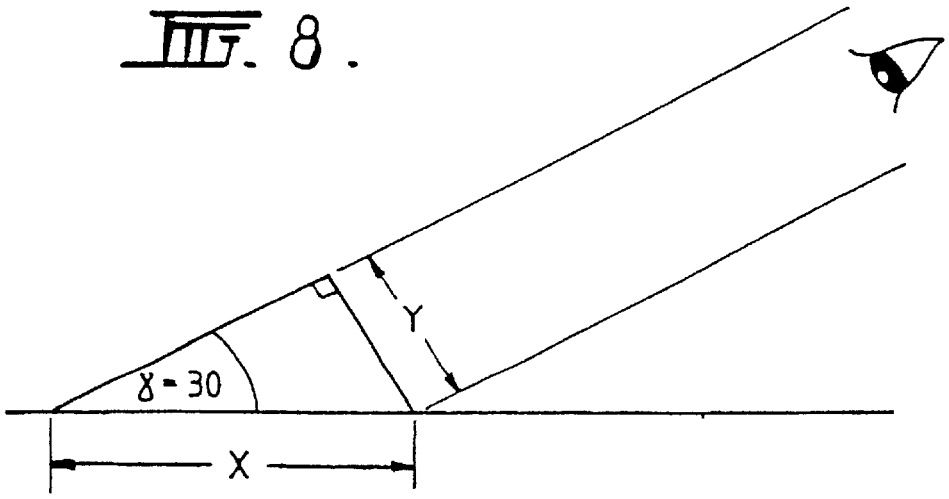

SECURITY DOCUMENTS

FIELD OF THE INVENTION

This invention relates to security documents or tokens, such as banknotes, travellers cheques, bonds, passports and the like, and to a method of producing same.

BACKGROUND OF THE INVENTION

The use of transparent windows in banknotes is now well known, as exemplified by PCT/AU82/00135 (WO 83/00659) Improved Banknotes and the Like, as is their use as a carrier for security features. One of these features is a transitory image of the type described in PCT/AU94/00302 (WO 94/29119) Embossing of Banknotes. The transitory nature of the image produced by embossing relies on the properties on the transparent polymer film, including excellent transparency/clarity at most viewing angles, and high gloss or reflective characteristics when viewed perpendicular to a light source, as is observed with a mirror.

SUMMARY OF THE INVENTION AND OBJECT

It is an object of the present invention to provide an improved security feature which includes an additional level of complexity, making the security feature more difficult to reproduce or copy.

The invention provides a security document or token, including a substrate, said substrate having a security device including a first embossing of the substrate having a predetermined feature, and a second embossing of smaller dimensions formed on said predetermined feature of said first embossing, said first embossing being formed to hide and reveal said second embossing at predetermined viewing angles.

In other words, the security device includes macro-embossing of the substrate and micro-embossing of a portion of the macro-embossing, the macro-embossing functioning to hide and reveal the micro-embossing at predetermined viewing angles.

By forming a second embossing or micro-embossing on the first embossing or macro-embossing, the first embossing or macro-embossing hides and reveals the secondary embossing or micro-embossing at predetermined viewing angles, and in this way provides a security feature which is then able to be produced by high-level security producers at a reasonable price, while being extremely difficult for an average security producer or counterfeiter to reproduce or simulate. The security feature is optically variable, but is nevertheless easy for the person in the street to use to identify a genuine document.

The substrate is preferably a polymer substrate, such as a laminated polymer substrate of the type used in the production of banknotes in Australia and other countries. The first embossing is preferably formed in a transparent portion of the substrate, although acceptable results can be achieved by forming the embossed portion in other regions of the substrate.

In a preferred form of the invention, the secondary embossing is preferably applied to the sides or lower portions of the first embossing.

By using the transparent portion of the polymer substrate, the first embossing is able to hide and reveal the finer second embossing at various viewing angles by using the gloss and transmission properties of the transparent substrate rather than the traditional reflection and absorption properties of printed media.

In a simple embodiment, the macro-embossing may comprise embossed array of lines formed in the substrate, the lines having a predetermined height H and a predetermined spacing S. The height H may vary from a minimum of about 5 microns to a maximum corresponding to the maximum embossable height of the substrate. The spacing S depends on the height and the ratio S:H is typically from about 6:1 to 2:1. The micro-embossing may be formed as lines or dots on the sides of the embossed lines such that the secondary embossed lines are hidden by the primary embossed lines other than at a predetermined range of angles. The secondary lines or dots are embossed to a height to the order of about 2 microns to about 20 microns which causes the clear substrate to appear matt at the predetermined viewing angles. If desired, lower portions of the macro-embossing, or portions of the substrate between adjacent macro-embossings, can be micro-embossed, either in addition to the sides, or as an alternative thereto.

In a preferred embodiment, the macro-embossing comprises lines having a height of from about 5 $\mu$m to 3 $\mu$m at a spacing of about 10 $\mu$m to 100 $\mu$m, and preferably a height of about 10 $\mu$m to about 25 $\mu$m and a spacing of about 30 $\mu$m to 100 $\mu$m. The upstanding lines created by the macro-embossing are micro-embossed with lines or dots on their sides in a manner which causes the clear substrate to appear matt at viewing angles of about 50 to about 45° to the surface of the substrate. The micro-embossing may be configured to form composite shapes, portraits, or any other recognisable device.

The macro and micro-embossing can be performed as part of the printing process and is particularly adapted to the intaglio printing process. Such processes are more clearly described in our prior application WO 94/29119.

The invention further provides a method of producing a security document or token, including forming an embossed security device having a predetermined feature in the substrate, and further embossing predetermined feature with a smaller embossing, such that the embossed security device hides and reveals the smaller embossing at predetermined viewing angles.

The security device is preferably embossed to a height of about 10 to 30 microns, and the sides of the embossing are in turn embossed to a height of about 2 to 20 microns the further embossing being positioned so that the first embossing hides and reveals the secondary embossing at predetermined viewing angles.

DESCRIPTION OF THE PREFERRED EMBODIMENT

In order that the invention may be more readily understood, a preferred embodiment will now be described with reference to the accompanying drawings in which:

FIG. 5 is a plan view of a printed document, such as a banknote, having the macro-embossing positioned within a clear window in the document;

FIG. 8 illustrates the calculation of the elongation ratio used in the formation of a micro-mask for creating a desired image in the micro-embossing.

DESCRIPTION OF PREFERRED EMBODIMENT

Figure 1:
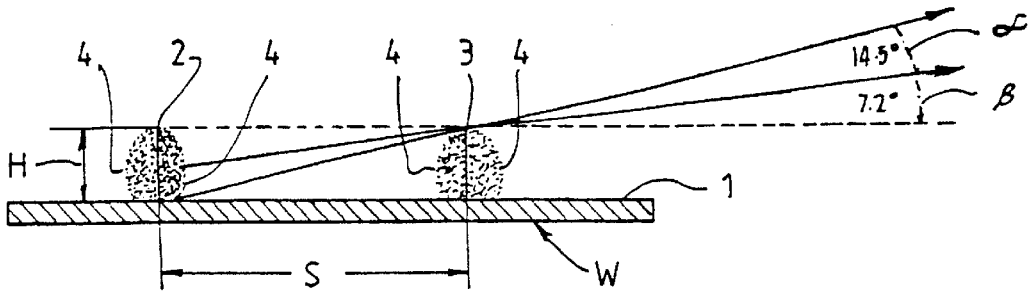
FIG. 1 is a schematic elevation of part of a banknote embossed in accordance with the invention.
Figure 2:
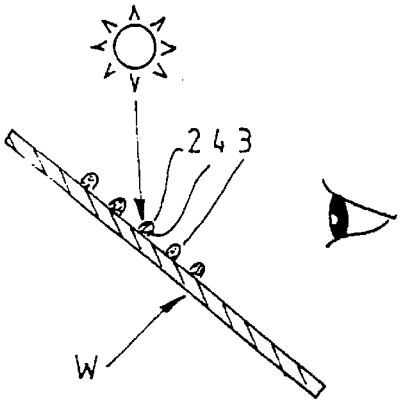
FIG. 2 is a schematic representation of the banknote when viewed at a predetermined angle which reveals the micro-embossing.
Figure 3:
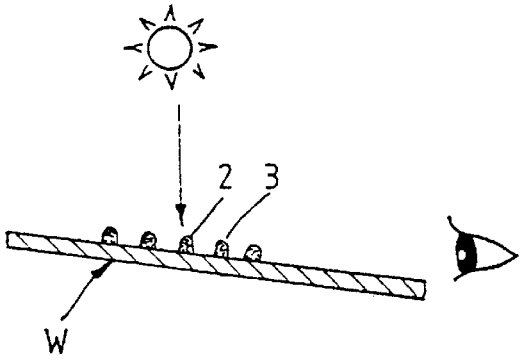
FIG. 3 is a view similar to FIG. 2 in which a banknote is viewed at an angle which hides the micro-embossing.

Referring firstly to FIGS. 1 to 4, a simple embodiment of the invention is depicted in FIG. 1 as including a substrate 1, such as the Guardian substrate used for the production of banknotes, and comprising a laminate of polymer film having a printed portion D and clear window portion W, as illustrated in FIG. 5, which has been macro-embossed with a series of parallel embossed lines 2, 3 having a height of about 20 μm and a spacing of 80 μm, each macro-embossed line having micro-embossing in the form of lines or dots 4 to a height of about 2 μm to 5 μm formed on its sides, such that the micro-embossing 4 is visible when viewed at angles equal or greater than a (14.5°), and is hidden when viewed at angles less than β (7.2°) as illustrated in FIGS. 1 and 2 and 1 and 3 respectively.

Figure 4A:
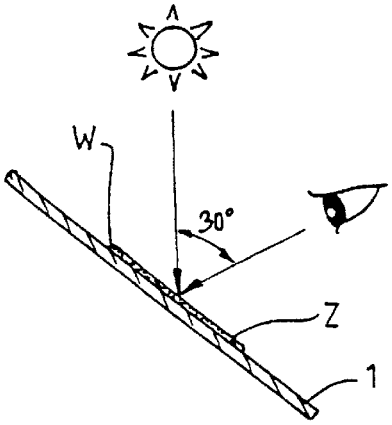
FIG. 4A is a schematic representation of a document embodying the invention when viewed.
Figure 4B:
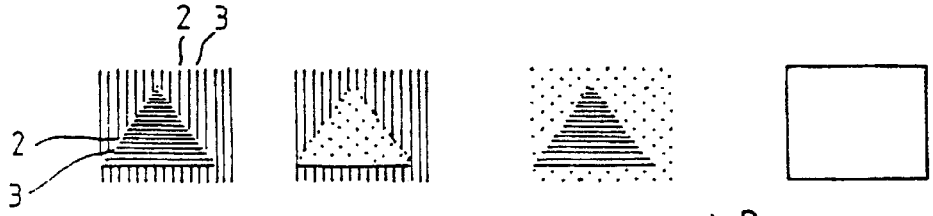
FIG. 4B illustrates various indicia when view under different conditions.
Figure 6A:
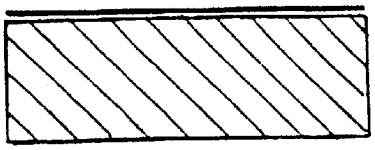
FIGS. 6A to 6H illustrates schematically the process of manufacturing a macro-embossing intaglio plate.
Figure 6B:
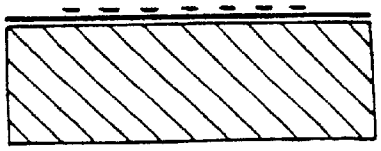
Figure 6C:
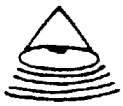
Figure 6C:
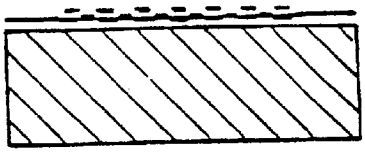
Figure 6D:
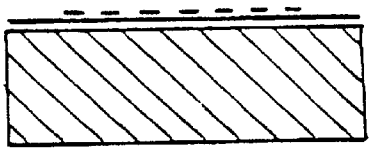
Figure 6E:
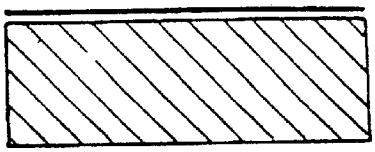
Figure 6F:
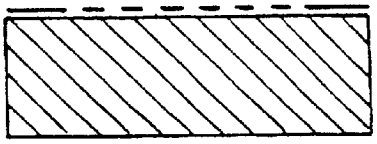
Figure 6G:
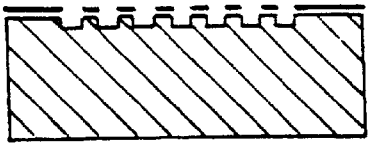
Figure 6H:
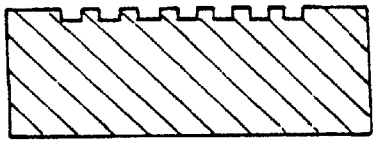

In FIG. 4A, the document substrate 1 is shown at a typical viewing angle of about 30° from normal and from this position the document can be tilted left or right, rotated up and down, or pivoted to the right or left, or any combination thereof. When viewed in this way, the clear window W appears to be substantially transparent, as illustrated in (d) of FIG. 4B. In the illustration of FIG. 4B the macro-embossed lines comprise a set of vertical parallel lines and a set of horizontal parallel lines in a generally triangular pattern, as illustrated in (a) of FIG. 4B. When this pattern is held at right angles to the light source, the horizontal lines are substantially transparent while the vertical lines are visible, as illustrated in (b) of FIG. 4B. Conversely, when the horizontal lines are at right angles to the light source, the horizontal lines are visible and the vertical lines are substantially transparent as illustrated in (c) of FIG. 4B. Thus, the sets of lines have three phases;

1. where a set of lines runs perpendicular to a light source, the image appears because the lines are reflecting light.
2. where a set of lines runs in the same direction as the light source, then this set of lines appears substantially transparent, and
3. where the light source is diffuse and the observer is looking through the clear area, the macro embossed lines are substantially invisible, as illustrated in (d) of FIG. 4B.

The micro-embossing 4 generates a secondary image that causes the embossed portions of the clear window W of the substrate 1 to appear matt when viewed at predetermined angles. Referring to Annexure B, the image at first becomes visible at the angle β (7.2° in this case). At angle α (14.5° in this case) all of the micro-embossing is visible. The image will not be to scale at this point. The image will be optimal at this angle in terms of continuity (low U/V ratio). However, the elongation angles have not been calculated at this angle. The chosen viewing angle for calculation of elongation angle is higher: 30°.

The image will be "recognisable" up to an angle of about 45°. The reason the image can not be viewed at angles higher than this is because the matt lines will become thinner and the apparent spacing will become wider, as illustrated in Annexure B.

The chosen viewing angle is chosen by: Average (14.5, 45)=30°.

The micro-embossing can be in the form of lines or dots of about 2 to about 5 μm in height. When micro lines/dots of this height are embossed to the sides of the macro-embossed lines 2, 3 using an intaglio printing machine, the lines maintain a particularly high fidelity since the polymer of the substrate 1 has a high molecular weight. Alternatively similar results are achieved when the micro lines/dots are formed on the portions of the substrate 1 between the lines 2, 3, either instead of the side embossings, or in addition thereto.

The space to height ratio S:H should be in the range of about 6:1 to about 2:1. The height may vary from about 5 μm to about 30 μm, which is close to the limit for the polymer substrate 1 of the preferred embodiment, although acceptable results are achievable in the height range from about 5 μm to about 20 μm. Within this range, the spacing between lines S can vary between about 15 μm and about 20 μm for a height of 5 μm, between about 30 μm and about 50 μm for a height of 10 μm, between about 30 μm and about 90 μm for a height of 15 μm, between about 40 μm and about 100 μm for a height of 20 μm, between about 50 μm and about 100 μm for a height of 25 μm, between about 60 μm and about 90 μm f or a height of 30 μm, between about 65 μm and about 75 μm for a height of 35 μm. The table of Annexure A illustrates the preferred height and spacing parameters, with the shaded area representing the most preferred spacings for heights between 5 and 35 μm. See annexed Table.

As illustrated in FIG. 5, the macro-embossing comprises horizontal lines, while the micro-embossing is performed in a manner which includes a micro-mask which reproduces a device such as an arrow, having the appearance illustrated in FIG. 5, when the document is tilted down and up respectively.

Turning now to FIGS. 6 to 8 of the drawings, the macro-embossing process is illustrated in FIGS. 6A to 6H and comprises the following steps:

1. Spin photo-resist polymer over a copper metal plate at an even thickness of up to 3 μm.
2. Position the macro-emboss mask over the photo-resist polymer.
3. Irradiate the surface with UV lamps.
4. Remove the UV lamps.
5. Remove the macro-emboss mask.
6. Dissolve and wash away the unexposed photo-resist polymer.
7. Using a ferric chloride and copper solution, etch the macro-emboss structure.
8. Remove the photo-resist polymer.

If desired the process can be preformed in opposite photo-resist, using negatives instead of positives.

Figure 7A:
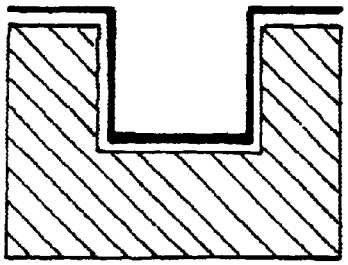
FIGS. 7A to 7M illustrates schematically the process of manufacturing a micro-embossing intaglio plate.
Figure 7B:
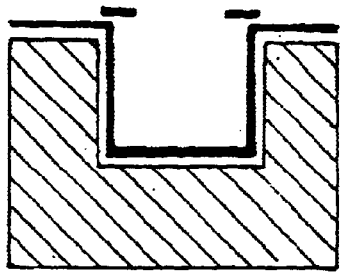
Figure 7C:
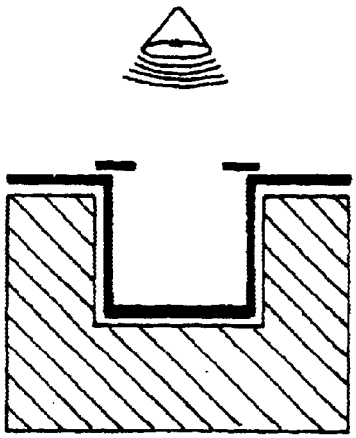
Figure 7D:
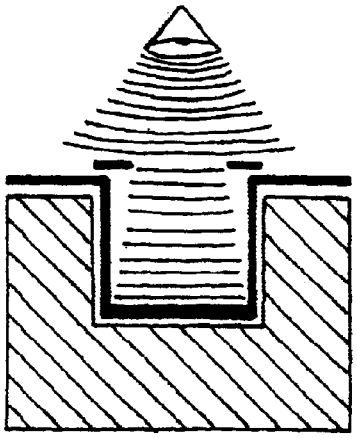
Figure 7E:
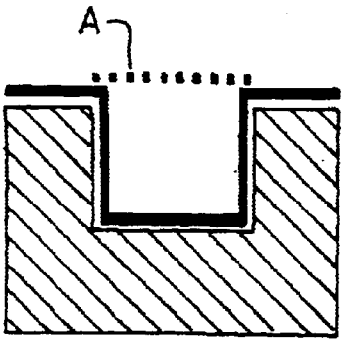
Figure 7F:
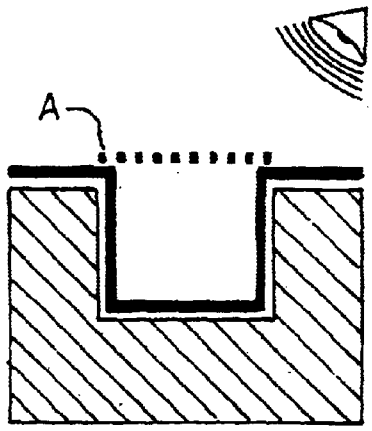
Figure 7G:
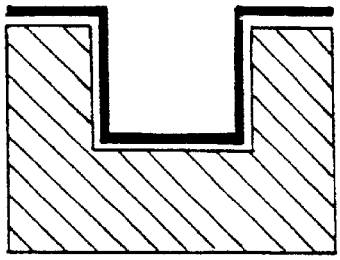
Figure 7H:
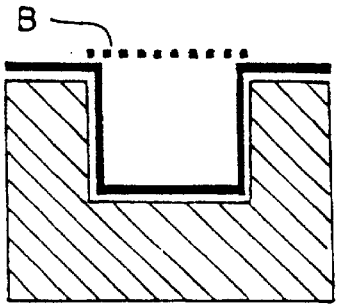
Figure 7I:
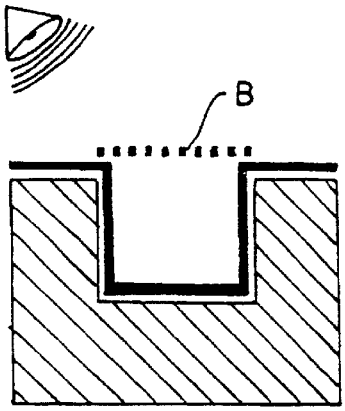
Figure 7J:
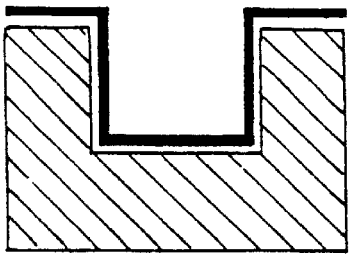
Figure 7K:
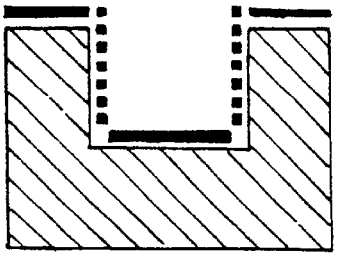
Figure 7L:
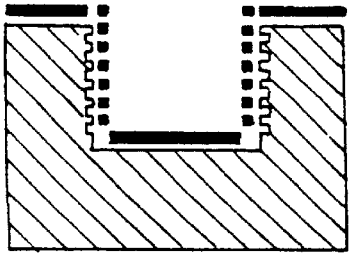
Figure 7M:
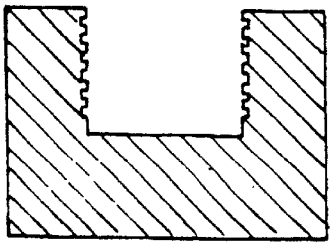

FIGS. 7A to 7M illustrate the preferred micro-embossing process, which involves the following steps:

1. Using the same plate as was used for the macro-embossing, spin photo-resist polymer over the metal plate, ensuring the resist enters at an even thickness into the macro-embossed structure, as shown in FIG. 7A.
2. Position the revised macro mask into the same position as the original macro mask. The revised macro mask will have the centre of all the macro-embossed lines removed.
3. Irradiate the surface with UV lamps. This should be performed to ensure the non-engraved sections of the plate and the bottom section of the macro-embosses are exposed.

4. Remove the UV lamps.
5. Remove the revised macro-emboss mask.
6. Position the first micro-embossing mask A over the photo-resist. Mask A consists of an elongated image. The image is elongated such that when viewed at the preferred optimum viewing angle of about 30°, the image appears in scale.
7. Irradiate the surface with UV lamps. The UV lamps should be placed at the optimum viewing angle of about 30° to the horizontal. These Lamps must irradiate a uniform light in order to create the correct exposure patterns as shown in FIG. 6.
8. Remove the UV lamps.
9. Remove Mask A.
10. Position the second micro-embossing mask B over the photo-resist. Mask B also consists of an elongated image, with an optimum viewing angle of 30°. Mask B may consist of a different image to Mask A.
11. Irradiate the surface with UV lamps. The UV lamps should be placed at the optimum viewing angle of about 30° to the horizontal, in the opposite direction as for Mask A.
12. Remove the UV lamps.
13. Remove Mask B.
14. Dissolve and wash away the unexposed photo-resist.
15. Using hydrochloric acid, etch the micro-emboss structures.
16. Remove the photo-resist polymer.

In the above process, both the micro-mask A and the micro-mask B consist of elongated images. The extent of the elongation is predetermined by the preferred viewing angle. The preferred viewing angle has been set at about 30° to the document.

Elongation Ratio; $x/y=1/\sin(\text{gamma})$ x=elongated length of image on substrate y=image viewing height With an optimum viewing angle of 30°, the extent of elongation is 2:1. For example, if an image has a viewing height of 15 mm, then the image created by the micro-mask will be 30 mm long on the substrate. The image is only to be elongated in the vertical viewing direction.

Following the above processes, the intaglio plate for achieving the macro and micro-embossing is made by the following steps:

1. A nickel metal plate is grown from the copper plate.
2. The nickel plate is pressed into a sheet of PVC.
3. PVC tiles are cut out and welded into the greater intaglio design. The directional embossing images are usually a subset of an overall intaglio design.
4. The metal printing plate is manufactured form the welded PVC master-tiles.
5. Intaglio printing is performed as described in WO 94/29119. Some areas of the intaglio plate may be inked as for traditional intaglio printing. The area of the intaglio plate which is intended for the directional emboss feature will not be inked.

The embossing process is a continuous process whereby the substrate to be embossed is passed through two rolling cylinders under high pressure. The embossed intaglio plate covers one of the two cylinders, the other cylinder is the impression cylinder. During the process, the substrate is forced into etchings of the plate by the impression cylinder. The substrate plastically deforms into the shape of the etchings. When the substrate exits the rolling cylinders, the macro-emboss reflexes partially back into shape, due to the nature of the material. The embossing on the substrate remains intact. However, the height of the embossing does not equal the height of the etching on the plate, a typical ratio is about 1:5. For this reason the maximum foreseeable final emboss on the relaxed substrate is about 35–40 $\mu$m.

What is claimed is:

1. A security document or token, including a substrate, said substrate having a security device including a first embossing of the substrate having a predetermined feature, and a second embossing of smaller dimensions formed on said predetermined feature of said first embossing, said first embossing being formed to hide and reveal said second embossing at predetermined viewing angles, wherein the first embossing includes line or dots having a Height H and Spacing S, the height varying from about 5 microns to a maximum corresponding to a maximum embossable height for the particular substrate, the spacing depending on the height with a ratio S:H varying from about 6:1 to about 2:1.

2. The document or token of claim 1, wherein the secondary embossing includes lines or dots which are embossed to a height of about 2 microns to about 6 microns.

3. The document or token of claim 1, wherein the first embossings have a height of about 5 microns to about 30 microns and a spacing of about 10 microns to about 100 microns.

4. A security document or token, including a substrate, said substrate having a security device including a first embossing of the substrate having a predetermined feature, and a second embossing of smaller dimensions formed on said predetermined feature of said first embossing, said first embossing being formed to hide and reveal said second embossing at predetermined viewing angles;

and wherein the first embossing has sides and lower portions, said second embossing being formed on a portion of the document or token selected from the group consisting of the sides, the lower portions, and a combination thereof.

5. A security document or token, including a substrate, said substrate having a security device including a first embossing of the substrate having a predetermined feature, and a second embossing of smaller dimensions formed on said predetermined feature of said first embossing, said first embossing being formed to hide and reveal said second embossing at predetermined viewing angles;

and wherein the height of the first embossings are from about 10 microns to about 25 microns and the spacing is from about 30 microns to about 100 microns, the second embossing being such that the substrate appears matt at viewing angles between about 5° and 45° to the substrate.

* * * * *